US005878670A

United States Patent [19]

Yamaguchi

[11] Patent Number: 5,878,670

[45] Date of Patent: Mar. 9, 1999

[54] METHOD OF FORMING A MARKING PORTION ON A GOLF BALL AND GOLF BALL BEARING A MARKING

[75] Inventor: Takehiko Yamaguchi, Saitama, Japan

[73] Assignee: Bridgestone Sports Co., Ltd., Tokyo, Japan

[21] Appl. No.: 979,545

[22] Filed: Nov. 26, 1997

[30] Foreign Application Priority Data

Nov. 29, 1996 [JP] Japan ..... 8-319483
Oct. 20, 1997 [JP] Japan ..... 9-286958

[51] Int. Cl.[6] ..... F41F 1/16

[52] U.S. Cl. ..... 101/492; 101/DIG. 40

[58] Field of Search ..... 101/483, 492, 101/DIG. 40

[56] References Cited

U.S. PATENT DOCUMENTS

| | | | |
|---|---|---|---|
| 555,813 | 9/1896 | Hale et al. | 101/492 |
| 4,803,922 | 2/1989 | Dennesen | 101/492 |
| 5,697,715 | 12/1997 | Kuroda et al. | 101/DIG. 40 |
| 5,782,966 | 7/1998 | Bui et al. | 101/492 |

OTHER PUBLICATIONS

Patent Abstract of Japan, "Transfer Foil for Golf Ball", Sakakibara et al, vol. 16 No. 376 Aug. 12, 1992 for Appl. No. 02–244991.

Patent Abstract of Japan, "Printing Method for Golf Ball", Yamana, vol. 9, No. 303, Nov. 30, 1985 for Appl. No. 58–24715.

*Primary Examiner*—Eugene Eickholt
*Attorney, Agent, or Firm*—Sughrue, Mion, Zinn, Macpeak & Seas, PLLC

[57] ABSTRACT

A method of forming a marking portion on a golf ball. A toner image is formed on a release sheet on its release side by an electrostatic copying machine, and a transfer (adhesive) sheet is then placed on the release sheet under pressure such that the adhesive surface thereof contacts the toner image so as to transfer the toner image onto the adhesive surface. Subsequently, the transfer sheet is removed from the release sheet, and the toner image on the transfer sheet is impregnated with a chemical which dissolves the toner image without causing the toner image to run. The transfer sheet is then pressed against a golf ball such that the toner image on the transfer sheet contacts the marking-portion forming surface of the golf ball so as to transfer the toner image onto the marking-portion forming surface. Subsequently, the transfer sheet is removed from the golf ball. The method improves adhesion of the toner image onto the marking-portion forming surface of the golf ball to thereby satisfactorily form the marking portion on the golf ball. A sheet having no adhesive surface (unadhesive sheet) may also be used for the transfer sheet.

9 Claims, 2 Drawing Sheets

METHOD OF FORMING A MARKING PORTION ON A GOLF BALL AND GOLF BALL BEARING A MARKING

BACKGROUND OF THE INVENTION

1. Field of the Invention

The present invention relates to a method of forming a marking portion such as a mark, a number, an own name (ordered characters or a figure), or the like on the surface of a golf ball through use of an electrostatic copying machine, a printer, or a like machine.

2. Description of the Related Art

The surface of a golf ball bears a marking portion such as a mark, a number, an own name, and the like. Conventionally, the marking portion is formed on the golf ball surface primarily by a transfer printing method or a pad printing method. In the transfer printing method, a transfer foil which has been formed on transfer paper through printing is transferred onto a marking-portion forming surface of the golf ball through application of heat and pressure. In the pad printing method, a marking portion is formed by applying ink on the surface of a golf ball through use of a stamp.

According to the transfer printing method, a large number of identical marks and numbers are printed on transfer paper, and these printed marks and numbers are continuously transferred onto golf balls. According to the pad printing method, a marking portion is formed by applying ink on each of a large number of golf balls through use of a stamp. Accordingly, these methods can efficiently print an identical marking portion on a large number of golf balls, but are not suited for printing different markings, for example, different own names, on golf balls in small lots. The above-mentioned conventional methods are technically difficult to print a photographic image onto a golf ball.

By contrast, Japanese Patent Publication No. JP-B-1991-34480 discloses a method suited for printing different markings on golf balls in small lots. According to this method, through use of an electrostatic copying machine, characters, a symbol, a figure, or the like is printed onto a copying substrate in the form of a reverse toner image, and then the copying substrate is applied onto a transparent resin layer formed on a marking-portion forming surface of a golf ball through application of heat and pressure, to thereby transfer the toner image onto the marking-portion forming surface.

However, the method of Japanese Patent Publication No. JP-B-1991-34480 has involved the following drawbacks (A) to (D). Regarding characteristics of markings formed by this method, a marking portion in the form of a transferred full-color toner image has been inferior to a marking portion in the form of a transferred monochromatic toner image in mechanical strength and fixation.

(A) The method of Japanese Patent Publication No. JP-B-1991-34480 has sometimes resulted in defective markings due to poor adhesion of a toner image onto the marking-portion forming surface of a golf ball. According to studies conducted by the present inventors, this is caused by the following:

(1) In an electrostatic copying machine, generally, copying paper onto which a toner image has been transferred from a drum is passed through a pair of fixing rollers so that the toner image is fixed on the copying paper. In this fixing step, silicone oil is fed onto the surface of a fixing roller which comes in contact with the toner image, in order to prevent the toner image from directly contacting the fixing roller surface. Thus, a small amount of silicone oil usually adheres to the surface of the toner image formed on the copying paper. According to the method of Japanese Patent Publication No. JP-B-1991-34480, a toner image which has been copied onto a copying substrate by means of an electrostatic copying machine is directly transferred onto a golf ball, so that a small amount of silicone oil is present between the marking-portion forming surface of the golf ball and the transferred toner image. As a result, the silicone oil impairs adhesion of the toner image to the marking-portion forming surface of the golf ball.

(2) In a method where a toner image formed on a copying substrate is transferred onto the surface of a golf ball, the copying substrate is preferably soft and extendable so as to closely fit onto the dimpled marking-portion forming surface of a golf ball. However, if a copying substrate is so soft and extendable, it will not pass through an electrostatic copying machine. Accordingly, in the method of Japanese Patent Publication No. JP-B-1991-34480, a copying substrate must be hard enough to pass through an electrostatic copying machine. However, such a copying substrate does not closely fit onto the marking-portion forming surface of a golf ball due to dimples formed thereon, resulting in formation of a slight gap between a toner image and the marking-portion forming surface of the golf ball. Again, such a gap impairs adhesion of the toner image to the marking-portion forming surface of the golf ball.

(B) In the method of Japanese Patent Publication No. JP-B-1991-34480, a marking portion on a golf ball, particularly, in the form of a transferred color toner image has exhibited poor endurance to impact applied thereto and has been easily damaged by impact.

(C) In the method of Japanese Patent Publication No. JP-B-1991-34480, when a copying substrate is pressed under a strong pressure against a golf ball in order to obtain a good fit between the marking-portion forming surface of the golf ball and the copying substrate for the purpose of solving the above problem (2), a toner image slips due to the applied pressure, resulting in a distorted transferred toner image.

(D) In the method of Japanese Patent Publication No. JP-B-1991-34480, in order to solve the above problem (2), an attempt to use a polypropylene sheet, which is soft and extendable, as a copying substrate has involved the following problem. The thickness of a copying substrate is preferably 20 $\mu$m to 80 $\mu$m in view of thermal conduction during transfer, whereas an electrostatic copying machine is designed to receive sheets having a thickness of approximately 100 $\mu$m. Thus, a polypropylene sheet having a thickness of 20 $\mu$m to 80 $\mu$m is not suited for use as a copying substrate. Also, a sheet on which a toner image is to be formed by an electrostatic copying machine must have a predetermined range of volume resistivity. However, the volume resistivity of a polypropylene sheet does not fall in the range. Thus, even when a polypropylene sheet having a thickness of approximately 100 $\mu$m is used as a copying substrate, a good toner image is not obtained. Further, a polypropylene sheet having a thickness of approximately 100 $\mu$m is usually manufactured without orientation. Since a nonorientation polypropylene sheet contracts and deforms when heated, the nonorientation polypropylene sheet passing through an electronic copying machine curls due to contraction and deformation caused by heat of a fixation roller section, disabling the machine operation.

SUMMARY OF THE INVENTION

The present invention has been accomplished in view of the foregoing fact, and an object of the present invention is to provide a method of forming a marking portion on a golf ball by transferring onto the golf ball surface a toner image which has been formed through copying by means of an electrostatic copying machine, a printer, or a like machine, the method improving adhesion of the toner image onto the marking-portion forming surface of the golf ball to thereby satisfactorily form the marking portion on the golf ball.

To achieve the above object, the present invention provides a method of forming a marking portion on a golf ball comprising: a first step for forming a toner image on a release sheet on its release side; a second step for placing a transfer sheet on the release sheet under pressure so as to transfer the toner image onto the transfer sheet and subsequently removing the transfer sheet from the release sheet; a third step for impregnating the toner image on the transfer sheet with a chemical which dissolves the toner image without causing the toner image to run; and a fourth step for pressing the transfer sheet against a golf ball such that the toner image on the transfer sheet contacts the marking-portion forming surface of the golf ball so as to transfer the toner image onto the marking-portion forming surface and subsequently removing the transfer sheet from the golf ball. The present invention also provides a golf ball that bears a marking portion formed by the above method.

In the present invention, a toner image which has been formed on a release sheet by means of an electrostatic copying machine, a printer, or a like machine is not directly transferred onto the marking-portion forming surface of a golf ball; i.e. the toner image is first transferred onto a transfer sheet, and then the toner image on the transfer sheet is transferred onto the marking-portion forming surface of a golf ball. Accordingly, when the toner image is transferred onto the marking-portion forming surface of a golf ball, the side of the toner image which was in contact with the release sheet, i.e. the silicone-oil-free side of the toner image, contacts the marking-portion forming surface. Therefore, no silicone oil is present between the marking-portion forming surface and the transferred toner image. Also, since the transfer sheet does not need to be passed through the electrostatic copying machine, a printer, or a like machine, the transfer sheet can be of a soft, extendable material. In addition, the toner image on the transfer sheet becomes adhesive through impregnation with a chemical. Thus, through use of a soft extendable material for the transfer sheet and through establishment of adhesiveness of the toner image on the transfer sheet, the toner image closely fits onto the dimpled marking-portion forming surface. Therefore, no gap is formed between the toner image and the marking-portion forming surface of a golf ball. Thus, the present invention improves adhesion of a toner image onto the marking-portion forming surface of a golf ball to thereby satisfactorily form a marking portion on the golf ball. Also, since the toner image which has been formed on the release sheet by means of an electrostatic copying machine, a printer, or the like is first transferred onto the transfer sheet, troublesome work of forming a reverse toner image is not involved.

DESCRIPTION OF THE PREFERRED EMBODIMENTS

Figure 1A:
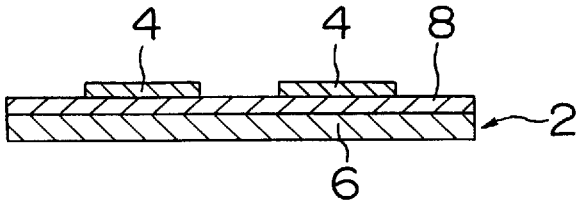
FIGS. 1A to 1F are views illustrating a method according to an embodiment of the present invention.

The steps of a method of the present invention will now be described in detail.

First step:

A toner image is formed on a release sheet on its release side. Examples of means for forming a toner image include an electrostatic copying machine (including a so-called color copier) and a printer (including a so-called color printer) that uses a toner. Examples of the release sheet include a paper or fluorocarbon fiber sheet coated or laminated with a release agent on a single side or both sides thereof. A marking portion is formed by characters, figures, symbols, and colors.

Second step:

A transfer sheet is placed on the release sheet under pressure such that the transfer sheet contacts the toner image so as to transfer the toner image onto the transfer sheet. Then, the transfer sheet is removed from the release sheet. A material for the transfer sheet is not particularly limited so long as the toner image on the release sheet can be transferred onto the transfer sheet. Examples of such a transfer sheet include a adhesive sheet having an adhesive surface and a sheet having no adhesive surface hereinafter referred to as unadhesive sheet).

Such an adhesive sheet is composed of a base material and an adhesive agent coated on the base material. The base material is formed of a single-layer sheet, a laminate sheet, or the like made of polypropylene, polyethylene terephthalate, a soft vinyl chloride resin, polyethylene, polytetrafluoroethylene, silicone rubber, kraft paper, or the like, while the adhesive agent is a resin adhesive agent such as an acrylic resin adhesive or a vinyl acetate resin adhesive, or a synthetic rubber adhesive agent. The base material is preferably of polypropylene or a soft vinyl chloride resin because it is soft and extendable so that the toner image closely fits onto the dimpled marking-portion forming surface of a golf ball. The adhesive agent is preferably an acrylic resin adhesive because of its good re-release property.

When the adhesive sheet is used as the transfer sheet in the second step, the adhesive sheet is placed on the release sheet under pressure such that the adhesive surface thereof contacts the toner image so as to transfer the toner image onto the adhesive surface. Then, the adhesive sheet is removed from the release sheet, thereby properly transferring the toner image onto the adhesive sheet.

Examples of the above-mentioned unadhesive sheet include a single-layer sheet, a laminate sheet, or the like made of polypropylene, polyethylene terephthalate, a soft vinyl chloride resin, polyethylene, polytetrafluoroethylene, silicone rubber, kraft paper, or the like. The unadhesive sheet is preferably of polypropylene or a soft vinyl chloride resin because it is soft and extendable, more preferably polypropylene in view of heat resistance and transfer property (re-release property).

When the unadhesive sheet is used as the transfer sheet in the second step, a toner image is properly transferred onto the unadhesive sheet by the steps of: placing the unadhesive sheet on the release sheet such that the unadhesive sheet contacts the toner image on the release sheet; interposing the release sheet and the unadhesive sheet between two leaves of a carrier sheet (described later); and applying heat and pressure to the interposed release sheet and unadhesive sheet through the carrier sheet by means of thermal rolls, an ironing press, or the like.

Before transferring a toner image from the release sheet to the transfer sheet, which is either adhesive or unadhesive sheet, a release liquid is preferably applied to the release sheet on the side opposed to the toner-image-formed side at a position corresponding to the toner image. This prevents a potential problem in the second step that part of the toner image remains on the release sheet with a resultant incomplete transfer of the toner image onto the transfer sheet. Examples of the release liquid include a kerosene type toner image release liquid available on the market.

Third step:

The toner image is impregnated with a chemical which dissolves the toner image without causing the toner image to run. This chemical must dissolve a synthetic resin contained in the toner without causing the toner to run. The chemical is preferably selected in accordance with the SP value (solubility parameter) of toner. That is, with the SP value of a toner being X and the SP value of the chemical being Y, the chemical is selected such that Y falls in the range from [X–(2±0.5)] to [X+(2±0.5)]. In other words, an absolute value of the difference between X and Y is preferably 2±0.5. When an absolute value of the difference between X and Y is in excess of 2.5, toner may not be properly transferred onto a golf ball. By contrast, when the absolute value is smaller than 1.5, a toner image impregnated with the chemical may run. The SP value Y of the chemical ranges preferably from [X–(2±0.3)] to [X+(2±0.3)], particularly preferably from [X–(2±0.2)] to [X+(2±0.2)].

No particular limitation is imposed on the chemical which dissolves a toner without causing the toner to run. Examples of such a chemical include organic solvents such as n-pentane, gasoline, n-hexane, diethyl ether, n-octane, vinyl chloride monomer, cyclohexane, isobutyl acetate, isopropyl acetate, methyl isopropyl ketone, butyl acetate, carbon tetrachloride, methyl propyl ketone, ethylbenzene, xylene, toluene, ethyl acetate, tetrahydrofuran, benzene, trichloroethylene, 1,1,1-trichloroethane, methyl ethyl ketone, chloroform, methylene chloride, acetone, hydrogen disulfide, acetic acid, pyridine, n-hexanol, cyclohexanol, n-butanol, isopropyl alcohol, dimethylformamide, nitromethane, ethanol, methanol, ethylene glycol, glycerol, and formamide. Since the components of a toner depend on a toner maker, the chemical may be selected in accordance with the SP value of a toner to be used. Chemicals may be used singly or in combination. For example, n-hexane and 1,1,1-trichloroethane may be used in combination at proper proportions.

Fourth step:

The transfer sheet is pressed against a golf ball such that the toner image on the transfer sheet contacts the marking-portion forming surface of the golf ball so as to transfer the toner image onto the marking-portion forming surface. Then, the transfer sheet is removed from the golf ball. The following surfaces serve partially or entirely as the marking-portion forming surface of a golf ball: the surface of a core ball, a cover, or an outermost protective coating layer for a two-piece ball; the surface of a cover or an outermost protective coating layer for a thread-wound ball; and the surface of a core ball or an outermost protective coating layer for one-piece ball. Usually, part of the surface of or the entire surface of a cover or an outermost protective coating layer serves as the marking-portion forming surface.

A material for a component of a golf ball whose surface serves as the marking-portion forming surface is not particularly limited. For example, the cover of a golf ball is made of an ionomer resin, an urethane resin, a polyester resin, a mixture of a polyurethane resin and a polyester resin, or the like; and the outermost protective coating layer of a golf ball is formed of a two-liquid curing type urethane coating material (a product of the cross-linking reaction between isocyanate and polyol such as acrylic polyol, polyester polyol, or polycarbonate polyol), an aqueous emulsion coating material (e.g. a polyester urethane resin coating material), or an ultraviolet curing type acrylic coating material. According to the present invention, the surface of a layer formed of any of these materials can be used as the marking-portion forming surface. Particularly preferably, the surface of a layer formed of an urethane material is used as the marking-portion forming surface. Since the layer formed of an urethane material is soft and extendable, a toner image transferred onto the layer surface is not damaged or cracked when the ball is hit.

Conditions of pressing a toner image against the marking-portion forming surface of a golf ball are not particularly limited. The pressing conditions may be set as adequate in accordance with the toner image's adhesiveness induced as a result of impregnation with the aforementioned chemical. In this case, the toner image is preferably heated and pressed against the marking-portion forming surface so as to improve fixation of the toner image on the marking-portion forming surface. A pressing member used for applying heat and pressure includes a rubber pad formed from silicone rubber having a rubber hardness (JIS-A) of 20 to 60, preferably 35 to 45, and a thickness of 1 to 20 mm, preferably 5 to 10 mm, thereby providing good appearance of a toner image on the marking-portion forming surface. An excessively hard or soft pressing member may cause the toner image to deform due to sliding of the toner image or due to heat applied thereto. Temperature to be applied under pressure is preferably 110° C. to 160° C., particularly preferably 130° C. to 140° C. Pressure is applied preferably for 0.1 sec to 10 sec, particularly preferably 0.5 sec to 1.5 sec. Also, after the toner image is transferred onto the marking-portion forming surface, the marking-portion forming surface may be heated so as to improve fixation of the toner image.

Others:

In the present invention, when a toner image is transferred onto the cover surface of a golf ball, after the transfer sheet is removed, clear coating serving as the outermost protective coating layer may be applied onto the cover surface in order to protect the cover and the transferred toner image. When a toner image is transferred onto the surface of the outermost protective coating layer of a golf ball, after the transfer sheet is removed, clear coating is preferably applied onto the surface of the outermost protective coating layer in order to protect the transferred toner image. The former and latter clear coatings may be formed of any of the aforementioned coating materials, namely a two component system urethane coating material, a water emulsion coating material, or an ultraviolet-curing acrylic coating material. A urethane coating material is particularly preferred. Since a certain solvent used in a coating material may dissolve a toner, the clear coatings are preferably formed of a coating material using a solvent which does not dissolve a toner or which dissolves a toner without causing the toner to run. Particularly, in the case of using a coating material using a solvent which dissolves a toner without causing the toner to run, the toner image is impregnated with the solvent, and consequently the toner is slightly dissolved, thereby improving fixation between the toner image and the marking-portion forming surface. Examples of such a solvent that dissolves a toner without causing the toner to run include a xylene-based solvent for use with an epoxy type toner. Since a coating material using a xylene-based solvent has a relatively long drying time, such a coating material can be readily applied with a brush. A styrene type toner prefers an alcohol-based solvent.

Also, in the present invention, the marking-portion forming surface of a golf ball may be physically or chemically surface-treated before a toner image is transferred onto the marking-portion forming surface, to thereby further improve adhesion of the toner image onto the marking-portion forming surface. Examples of such surface treatment include surface roughening and surface modification, specifically plasma treatment, corona discharge treatment, exposure to ultraviolet, chlorine treatment, primer coating, wiping with an organic solvent, silane coupling agent coating, honing, and physical surface-roughening The above-mentioned primer coating preferably uses a primer containing a polyurethane resin (3 wt.% to 5 wt.%), a chlorinated polyolefin resin (3 wt.% to 5 wt.%), a hydrocarbon solvent (70 wt.% to 85 wt.%), a ketone solvent (5 wt.% to 10 wt.%), and an alcohol solvent (3 wt.% to 6 wt.%). An example of the above-mentioned process of wiping with an organic solvent may include a process of wiping off a slipping agent existing at the outermost protective coating layer of a golf ball with an organic solvent such as acetone. In the case of forming a marking portion on the outermost protective coating layer of a golf ball, if a slipping agent is contained in the protective coating, the slipping agent impairs fixation of a toner image on the marking-portion forming surface. If such a slipping agent is wiped off by the above-described wiping process, fixation of a toner image on the marking-portion forming surface can be improved. The above-mentioned physical surface-roughening can be performed through use of a wire brush, a sander, an elastic grindstone, or buff, for example.

EXAMPLES

Example 1

A marking portion was formed on a golf ball according to the procedure shown in FIGS. 1A to 1F. As shown in FIG. 1A, a toner image 4 was formed on a release sheet 2 on its release side by means of an electrostatic copying machine. The release sheet 2 was composed of support paper 6 and a release agent coating 8 applied onto one side of the support 6. A color copying machine, PRETALE 650, manufactured by Ricoh Company, Ltd. was used as the electrostatic copying machine. Through use of PRETALE 650, the full-color toner image 4 was formed (this also applies to Examples 2 to 5 and Comparative Examples 1 and 2, which will be described later).

Figure 1B:
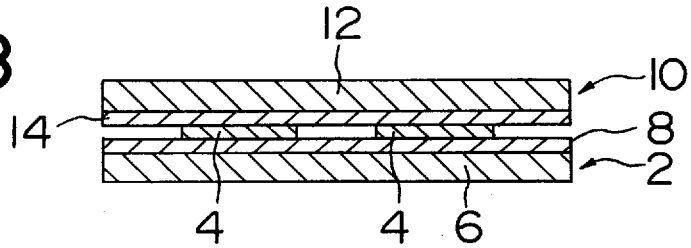
Figure 1C:
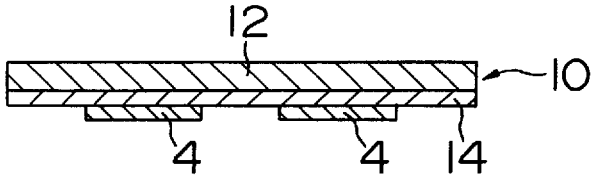

As shown in FIG. 1B, an adhesive sheet (transfer sheet) 10 was placed on the release sheet 2 under pressure such that the adhesive surface thereof contacted the toner image 4. Then, the adhesive sheet 10 was removed from the release sheet 2. The adhesive sheet 10 was composed of a base material 12 made of polypropylene, and an adhesive agent layer 14 made of an acrylic resin and formed on one side of the base material 12. Thus was obtained the adhesive sheet 10 which bore the toner image 4 on the adhesive agent layer 14 thereof, as shown in FIG. 1C.

Figure 1D:
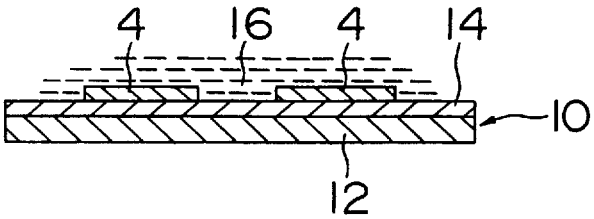
Figure 1E:
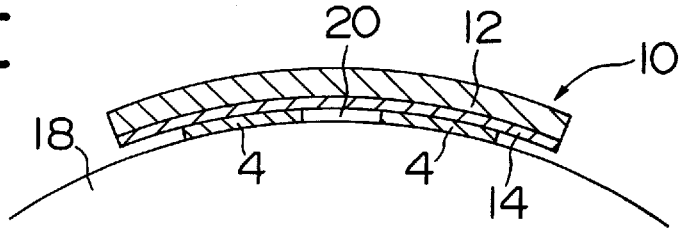
Figure 1F:
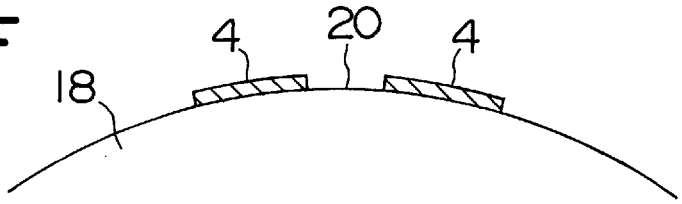

As shown FIG. 1D, the toner image 4 was then impregnated with a chemical 16 which dissolved the toner image 4 without causing the toner image 4 to run. The chemical 16 was a mixture of normal hexane and 1,1,1-trichloroethane at a weight ratio of 90:10. As shown in FIG. 1E, through use of an unillustrated pressing member, the adhesive sheet 10 was heated and pressed against the marking-portion forming surface 20 of the golf ball 18 so as to transfer the toner image 4 onto the marking-portion forming surface 20. The pressing member for application of heat and pressure was a silicone rubber pad having a rubber hardness (JIS-A) of 40 and a thickness of 5 mm. A temperature (surface temperature of the pad) of 140° C. was applied under pressure, and pressure was applied for 1 second. Further, as shown in FIG. 1F, the adhesive sheet 10 was removed from the golf ball 18. Then, clear coating was applied onto the cover surface of the golf ball 18, thus completing the golf ball 18 that bears a marking.

Example 2

Figure 2A:
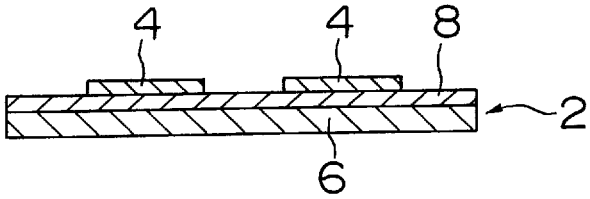
FIGS. 2A to 2F are views illustrating a method according to another embodiment of the present invention.

A marking portion was formed on a golf ball according to the procedure shown in FIGS. 2A to 2F. As shown in FIG. 2A, a toner image 4 was formed on a release sheet 2, which was similar to that used in Example 1, on its release side by means of an electrostatic copying machine.

Figure 2B:
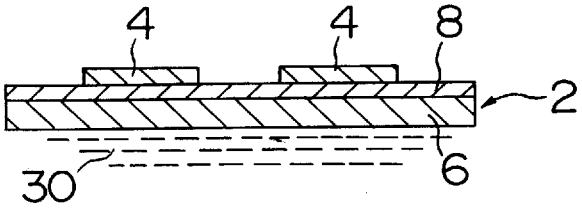
Figure 2C:
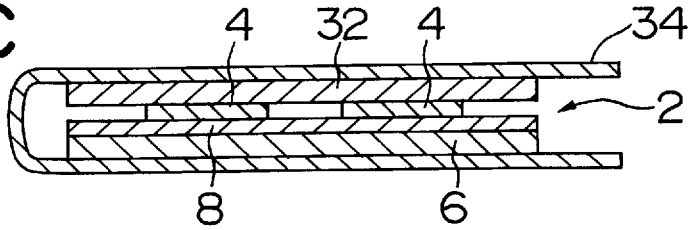

Next, as shown in FIG. 2B, a release liquid 30 was applied to the release sheet 2 on its back side at a position corresponding to the toner image 4. The release liquid 30 was a kerosene type toner image release liquid available on the market. Thereafter, an unadhesive sheet (transfer sheet) 32 was placed on the release sheet 2 so as to contact the toner image 4. The release sheet 2 and the unadhesive sheet 32 were interposed between the two halves of a folded carrier sheet 34 and subjected to heat and pressure through the carrier sheet 34. The unadhesive sheet 32 used was a polypropylene sheet, and the carrier sheet 34 used was an ordinary copying sheet of paper. Thus was obtained the unadhesive sheet 32 onto which the toner image 4 was transferred, as shown in FIG. 2D.

Figure 2D:
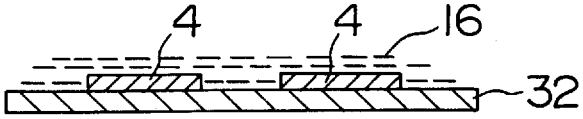
Figure 2E:
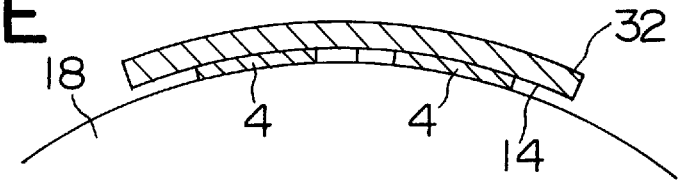
Figure 2F:
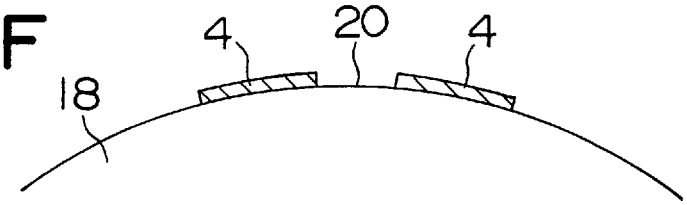

As shown in FIG. 2D, the toner image 4 was then impregnated with a chemical 16 which dissolved the toner image 4 without causing the toner image 4 to run. The chemical 16 was identical to that used in Example 1. As shown in FIG. 2E, through use of an unillustrated pressing member, the unadhesive sheet 32 was heated and pressed against the marking-portion forming surface 20 of the golf ball 18 so as to transfer the toner image 4 onto the marking-portion forming surface 20. Conditions of this transfer were identical to those of Example 1. Further, as shown in FIG. 2F, the unadhesive sheet 32 was removed from the golf ball 18. Then, clear coating was applied onto the cover surface of the golf ball 18, thus completing the golf ball 18 that bears a marking.

Example 3

A toner image was transferred onto a golf ball in a manner similar to that of Example 1 except that the marking-portion forming surface of the golf ball was treated by applying a primer containing a polyurethane resin thereto, in place of plasma treatment, before a toner image transfer process was started.

Example 4

A toner image was transferred onto a two-piece golf ball composed of a polybutadiene rubber core and an ionomer resin cover in a manner similar to that of Example 3 except for the following: the marking-portion forming surface of the golf ball was coated with a polyurethane clear-coating material; and the same primer as that used in Example 3 was applied onto the clear coating.

Example 5

A toner image was transferred onto a two-piece golf ball identical to that used in Example 4 in a manner similar to that of Example 3 except for the following: the surface of the golf ball was coated white with a polyurethane coating material containing a white pigment; and the same primer as that used in Example 3 was applied onto the white coating.

Comparative Example 1

A toner image was transferred onto a golf ball in a manner similar to that of Example 4 except for the following: a polypropylene base material identical to that used in Example 1 was stuck onto one side of an ordinary copying sheet of paper, and then a reverse toner image was formed on the surface of the polypropylene base material through use of an electronic copying machine, obtaining the adhesive sheet; and a chemical which dissolves the toner without causing the toner to run was not used. No clear coating was applied onto the transferred toner image.

Comparative Example 2

A toner image was transferred onto a golf ball in a manner similar to that of Example 4 except that a chemical which dissolves the toner without causing the toner to run was not used. No clear coating was applied onto the transferred toner image.

The golf balls of the Examples and Comparative Examples underwent the following evaluation of a transferred image, peeling-with-adhesive-tape test, and endurance test.

Evaluation of a Transferred Image

The golf balls of Examples 1 to 5 and Comparative Examples 1 and 2 were visually observed for a transferred image thereon. The following criteria of evaluation were used.

Peeling-with-Adhesive-Tape Test

The golf balls of Examples 1 to 5 (before clear coating was applied onto a transferred image) and the golf balls of Comparative Examples 1 and 2 were tested for fixation of a transferred image on a ball surface by the following procedure. An adhesive tape (cellophane tape) was stuck onto a transferred image on a ball and then peeled off. The following criteria of evaluation was used.

Good: A transferred image does not come off.

Poor: A transferred image comes off.

Endurance Test

The golf balls of Examples 1 to 5 underwent an impact endurance test, a hitting test, a sand wear test, and a sand-water wear test as described below. A reference ball bore a marking portion which was pad-printed on a clear coating surface with a two component system urethane (TDI) ink. In the impact endurance test, the golf balls were hit 100 times through use of an endurance testing machine. In the hitting test, the golf balls were hit 3 times by a pitching wedge at a head speed of 18.5 ms. In the sand wear test, the golf balls and sand were placed in a ball mill, which was then operated for 2 hours. In the sand-water wear test, the golf balls, sand, and water were placed in the ball mill, which was then operated for 4 hours.

The following criteria of evaluation was used.

Better: Better than the reference ball

Equivalent: Equivalent to the reference ball

Poor: Inferior to the reference ball

The results are shown in Table 1. As seen from Table 1, the method of forming a marking portion on a golf ball according to the present invention can form on a golf ball a transferred image that is quite clear and perfect and that has excellent endurance and adhesion to the surface of the golf ball.

TABLE 1

| | Example 1 | Example 2 | Example 3 | Example 4 | Example 5 | Com. Example 1 | Com. Example 2 | Reference ball |
|---|---|---|---|---|---|---|---|---|
| Conditions | | | | | | | | |
| Surface for transfer | Cover surface | Cover surface | Cover surface | Clear coating surface | White coating surface | Clear coating surface | Clear coating surface | Clear coating surface |
| Treatment before transfer | Plasma | Plasma | Primer | Primer | Primer | Primer | Primer | No |
| Transfer sheet | Poly-propylene | Poly-propylene | Poly-propylene | Poly-propylene | Poly-propylene | Poly-propylene | Poly propylene | — |
| Chemical treatment of image to be transferred | Yes | Yes | Yes | Yes | Yes | No | No | — |
| Treatment after transfer | Clear coating on entire surface | Clear coating on entire surface | Clear coating on entire surface | Partial clear coating | Clear coating on entire surface | No | No | No |
| Evaluation of transferred image | A | A | A | A | A | D | C | |
| Peeling-with-adhesive-tape test | Good | Good | Good | Good | Good | Poor | Poor | — |
| Endurance test | | | | | | | | |
| Impact endurance | Equivalent | Equivalent | Equivalent | Equivalent | Equivalent | — | — | Equivalent |
| Hitting | Equivalent | Equivalent | Equivalent | Equivalent | Equivalent | — | — | Equivalent |
| Sand wear | Equivalent | Equivalent | Equivalent | Equivalent | Equivalent | — | — | Equivalent |
| Sand-water wear | Better | Better | Better | Better | Better | — | — | Equivalent |

A: A transferred image is very clear and perfect.

B: A transferred image is substantially clear and almost perfect.

C: A transferred image is partially missing.

D: A transferred image is unclear and partially missing.

What is claimed is:

1. A method of forming a marking portion on a golf ball, comprising the steps of:

forming a toner image on a release sheet on its release side;

placing a transfer sheet on the release sheet under pressure so as to transfer the toner image onto the transfer sheet and subsequently removing the transfer sheet from the release sheet;

impregnating the toner image on the transfer sheet with a chemical which dissolves the toner image without causing the toner image to run; and pressing the transfer sheet against the marking-portion forming surface of the golf ball so as to transfer the toner image onto the marking-portion forming surface and subsequently removing the transfer sheet from the golf ball.

2. A method of forming a marking portion on a golf ball according to claim 1, wherein the chemical has a solubility parameter that falls in a range from [X−(2±0.5)] to [X+(2±0.5)] where X is the solubility parameter of a toner to be used.

3. A method of forming a marking portion on a golf ball according to claim 1, wherein the surface of a cover layer of the golf ball serves as the marking-portion forming surface, and after the transfer of the toner image onto the marking-portion forming surface and the subsequent removal of the transfer sheet, clear coating is applied onto the surface of the cover layer of the golf ball.

4. A method of forming a marking portion on a golf ball according to claim 1, wherein the surface of an outermost protective coating layer of the golf ball serves as the marking-portion forming surface.

5. A method of forming a marking portion on a golf ball according to claim 4, wherein after the transfer of the toner image onto the marking-portion forming surface and the subsequent removal of the transfer sheet, clear coating is further applied onto the surface of the outermost protective coating layer of the golf ball in order to protect the toner image.

6. A method of forming a marking portion on a golf ball according to claim 5, wherein a material for the clear coating contains a chemical which dissolves the toner image without causing the toner image to run.

7. A method of forming a marking portion on a golf ball according to claim 1, wherein the marking-portion forming surface of the golf ball undergoes surface treatment before the toner image is transferred onto the marking-portion forming surface.

8. A method of forming a marking portion on a golf ball according to claim 7, wherein the surface treatment is selected from the group consisting of plasma treatment, corona discharge treatment, exposure to ultraviolet, chlorine treatment, primer coating, wiping with an organic solvent, silane coupling agent coating, honing, and physical surface-roughening.

9. A golf ball that bears a marking portion formed by the method according to claim 1.

* * * * *